US009140417B2

(12) United States Patent
Chen

(10) Patent No.: US 9,140,417 B2
(45) Date of Patent: Sep. 22, 2015

(54) DUAL-LENS ZOOMING FLASHLIGHT

(71) Applicant: XianQing Chen, Ningbo (CN)

(72) Inventor: XianQing Chen, Ningbo (CN)

( * ) Notice: Subject to any disclaimer, the term of this patent is extended or adjusted under 35 U.S.C. 154(b) by 165 days.

(21) Appl. No.: 14/010,036

(22) Filed: Aug. 26, 2013

(65) Prior Publication Data

US 2014/0240969 A1 Aug. 28, 2014

(30) Foreign Application Priority Data

Feb. 26, 2013 (CN) ..... 2013 2 0085784 U

(51) Int. Cl.

| | |
|---|---|
| ***F21L 4/04*** | (2006.01) |
| ***F21L 4/00*** | (2006.01) |
| ***F21V 5/00*** | (2015.01) |
| ***F21V 14/06*** | (2006.01) |
| *F21Y 101/02* | (2006.01) |

(52) U.S. Cl.

CPC ..... *F21L 4/005* (2013.01); *F21L 4/045* (2013.01); *F21V 5/008* (2013.01); *F21V 14/065* (2013.01); *F21Y 2101/02* (2013.01)

(58) Field of Classification Search

CPC ..... F21L 4/04; F21L 4/045; F21L 4/005; F21L 4/00; F21V 5/008; F21V 14/06; F21V 14/065; F21Y 2101/02

USPC ..... 362/187

See application file for complete search history.

(56) References Cited

U.S. PATENT DOCUMENTS

| | | | | |
|---|---|---|---|---|
| 1,621,955 | A * | 3/1927 | Schiffner | 362/187 |
| 1,753,614 | A * | 4/1930 | Meroussis | 362/187 |
| 2003/0231490 | A1 * | 12/2003 | Echterling | 362/169 |
| 2006/0256563 | A1 | 11/2006 | Uke et al. | |
| 2010/0296066 | A1 * | 11/2010 | Ou Yang et al. | 353/119 |

FOREIGN PATENT DOCUMENTS

| | | |
|---|---|---|
| AU | 2012261379 | 8/2013 |
| CN | 102635788 | 8/2012 |
| CN | 202532197 | 11/2012 |
| EP | 2161491 | 10/2010 |
| GB | 416101 | 9/1934 |
| WO | WO 2006/072885 | 7/2006 |
| WO | 2013/120234 | 8/2013 |

* cited by examiner

*Primary Examiner* — Alan Cariaso

(74) *Attorney, Agent, or Firm* — Hamre, Schumann, Mueller & Larson, P.C.

(57) ABSTRACT

Disclosed is a dual-lens zooming flashlight, comprising a lamp cap, a cylinder body, a luminous element and two plano-convex lenses, characterized in that: the lamp cap is sleeved at the front part of the cylinder body, rotated together with the cylinder body and connected with the cylinder body in a relatively telescopic manner, the two plano-convex lenses are both arranged in such a manner of being perpendicular to an optic axis in front of the luminous element, wherein the first plano-convex lens is fixedly arranged at the front end of the cylinder body and keeps a constant distance from the luminous element, and the second plano-convex lens is arranged at the front end of the lamp cap and capable of moving backwards and forwards in relation to the luminous element along with rotary telescopic motion of the lamp cap and the cylinder body.

12 Claims, 5 Drawing Sheets

DUAL-LENS ZOOMING FLASHLIGHT

TECHNICAL FIELD

The present invention belongs to the technical field of lighting fixtures, and in particular relates to a dual-lens zooming flashlight.

BACKGROUND

A variety of lighting fixtures have emerged in order to meet people's demands on different kinds of lighting in daily life and at work, and flashlight is widely used due to its lightness and carrying convenience. In general, common flashlights include such major components as cylinder body, lamp cap, luminous element and batteries, and most of them are non-focusable and are nonadjustable in lighting range and brightness, as a result, their lighting range and brightness typically fail to meet the working demand under some situations. Consequently, there are plenty of focus-variable flashlights at present, e.g. Chinese patent CN201210090919.5 entitled Dual Lens Stage Zooming Flashlight, this flashlight comprises an LED light source, a moving lens, a fixed lens, a focusing cover, a cylinder body, a steel ball, a spring and the like; both the fixed lens and the moving lens are arranged in a manner of being perpendicular to an optic axis in front of the LED light source; a constant distance is kept between the fixed lens and the LED light source, and the moving lens is capable of moving back and forth in relation to the LED light source. The lighting area and brightness of exit light can be regulated by changing the distance between the moving lens and the LED light source; in addition, a certain number of fixed holes are arranged on the cylinder body, shallow grooves are arranged among the fixed holes, the steel ball is pressed onto the fixed holes by the spring and can slide from one fixed hole to another along the shallow grooves to achieve stage zooming location. This flashlight, though capable of zooming, has a relatively complex structure; the moving lens is arranged on a moving lens holder, a light transmitting lens also needs to be arranged on the head ring of the lamp cap, and during zooming, movement of the moving lens holder is driven by rotation of the focusing cover, which indispensably leads to arrangement, inside the flashlight, of a hollow cavity used for back-and-forth movement of the moving lens holder, so the flashlight has to be large in length, and becomes non-contractable to further bring difficulty in carrying and storage; meanwhile, the location mechanism is also quite complex, which not only results in troublesome manufacturing and high cost, but is also disadvantageous to maintenance, therefore, further improvement still needs to be applied to its structure.

SUMMARY

The technical problem to be solved by the present invention is to provide, based on the aforementioned technical status, a simply-structured and conveniently-manufactured dual-lens zooming flashlight, which can achieve adjustment for lighting range and brightness through zooming and has the characteristics of reasonable design and good lighting effect.

The technical scheme adopted in the invention for solving the technical problems above is as follows: a dual-lens zooming flashlight comprises a lamp cap, a cylinder body, a luminous element and two plano-convex lenses, characterized in that: the lamp cap is sleeved at the front part of the cylinder body, rotated together with the cylinder body and connected with the cylinder body in a relatively telescopic manner, the two plano-convex lenses are both arranged in such a manner of being perpendicular to an optic axis in front of the luminous element, wherein the first plano-convex lens is fixedly arranged at the front end of the cylinder body and keeps a constant distance from the luminous element, and the second plano-convex lens is arranged at the front end of the lamp cap and capable of moving backwards and forwards in relation to the luminous element along with rotary telescopic motion of the lamp cap and the cylinder body.

As an improvement, the inner cavity of the cylinder body is divided into two sections, i.e. a front section and a rear section, wherein a lamp holder for fixing the luminous element is arranged on the front section, a battery compartment is arranged on the rear section, the luminous element is arranged on the lamp holder, the first plano-convex lens is arranged in front of the luminous element, and the first plano-convex lens and the lamp holder are compressed and fixed by a lens locking ring.

As an improvement, a convex ring which is abutted against the front end of the cylinder body is formed at the front part of the lamp holder, the outer surface of the convex ring and the outer surface of the front part of the lamp holder are provided with external threads, an internal thread corresponding to the external thread on the front part of the lamp holder is arranged on the inner wall of the front end of the cylinder body, and the lamp holder is arranged inside the cylinder body by means of threaded connection and is limited by end face fit of the convex ring and the cylinder body.

As an improvement, an internal thread which fits the external thread of the convex ring is arranged at the inner side of the lens locking ring, a step which can be used for placement of the first plano-convex lens is arranged at the inner side of the convex ring, and the lens locking ring is sleeved on the convex ring and is fixed with the lamp holder in a manner of threaded connection.

As an improvement, an external thread is formed at the outer side of the front part of the cylinder body, a corresponding internal thread is arranged at the inner side of the rear end of the lamp cap, an expanding section for telescopic motion of the cylinder body is formed at the inner end of the internal thread structure of the lamp cap, and the front part of the cylinder body is telescopically sleeved at the rear part of the lamp cap through the threaded structure and limited by fit between the lens locking ring and the step surface of the expanding section.

As a further improvement, the luminous element is an LED lamp installed on an LED circuit board and sleeved in the lamp holder, a pressure ring is arranged between the LED lamp and the first plano-convex lens, a battery pack is arranged inside the battery compartment, and the front end of the battery compartment is provided with a contact, which is electrically connected with the LED circuit board.

As a further improvement, the battery compartment is cylindrical and is internally divided into a receiving cavity for placement of three batteries, and a waterproof ring and a locking ring are arranged at the tail of the battery compartment.

As a further improvement, the front part of the lamp cap is in threaded connection with a head ring, and the second plano-convex lens is arranged between the head ring and the lamp cap, and is compressed and fixed by means of threaded connection between the head ring and the lamp cap.

As a further improvement, a waterproof ring is lined between the second plano-convex lens and the head ring.

Finally, the rear end of the cylinder body is connected with a tail cover, a control switch is arranged inside the tail cover, and a round hole, which is used for a button of the control switch to stretch out is arranged at the rear end of the tail cover.

Compared with the prior art, the present invention has the advantages that: distance variation between the cylinder body and the lamp cap is achieved along with rotation of the both by zooming of the two plano-convex lenses (wherein the second plano-convex lens is fixed on the lamp cap and the first plano-convex lens is arranged on the lamp holder), so as to reach the purpose of zooming and greatly improve lighting range and brightness. The dual-lens zooming flashlight is simple in structure, reasonable in design and free from additional arrangement of a focusing cover and a light transmitting lens, thus simple manufacturing is realized and cost is saved remarkably; furthermore, the dual-lens zooming flashlight is convenient for carrying and storage due to the telescopic property of the cylinder body.

BRIEF DESCRIPTION OF THE DRAWINGS

FIG. 6A is an initial state of zooming light path view in the zooming process. FIG. 6B is a zooming light path view in the zooming process.

DETAILED DESCRIPTION

Figure 1:
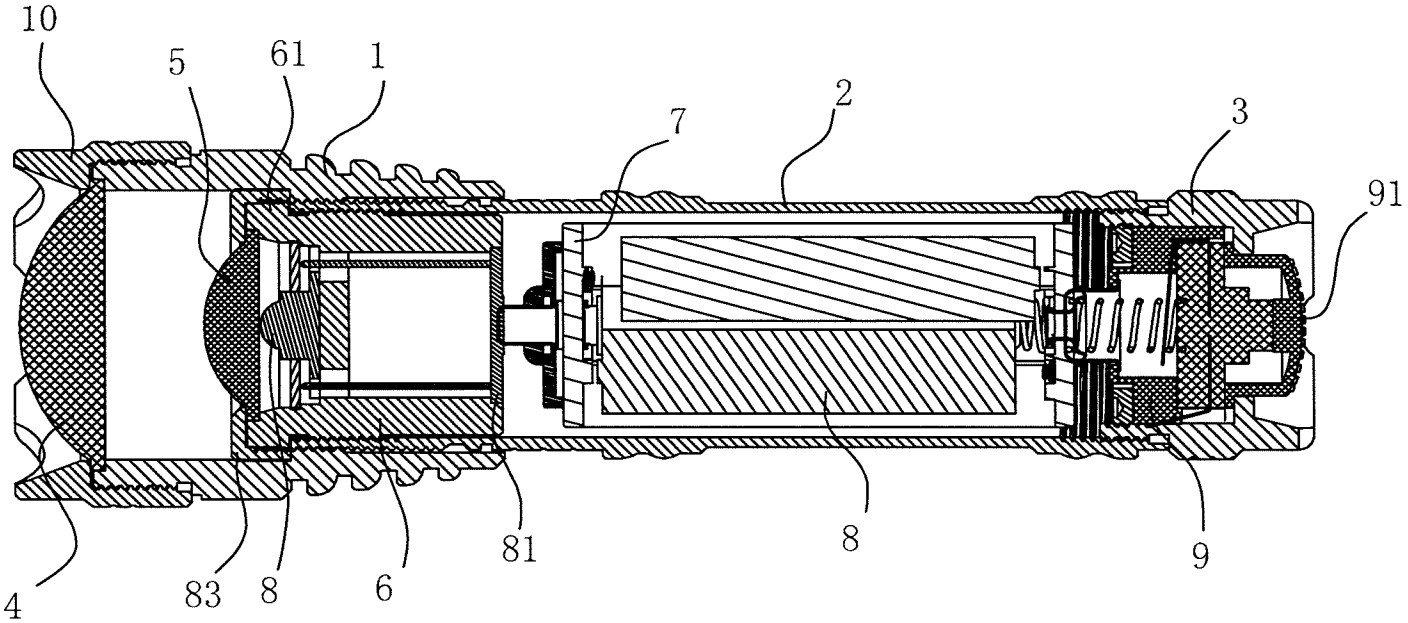
FIG. 1 is a structural section view of the present invention when the cylinder body is stretched.
Figure 2:
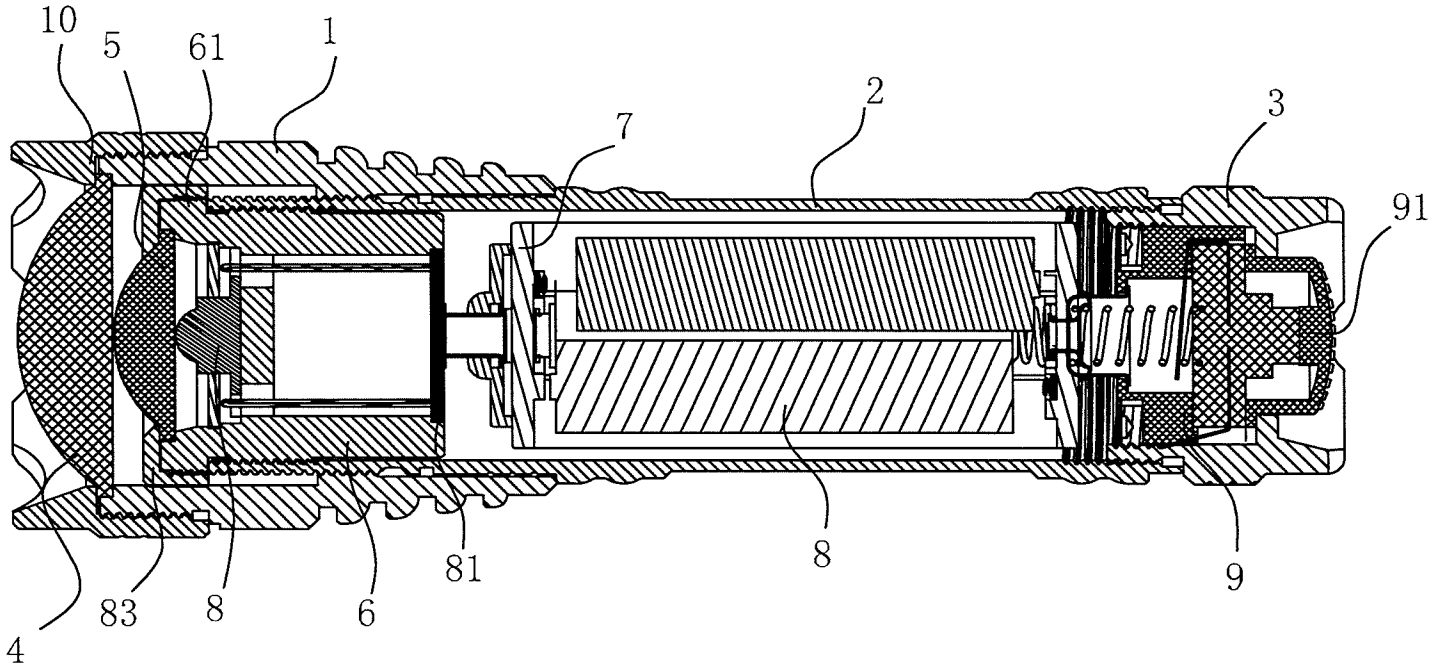
FIG. 2 is a structural section view of the present invention when the cylinder body is contracted.
Figure 3:
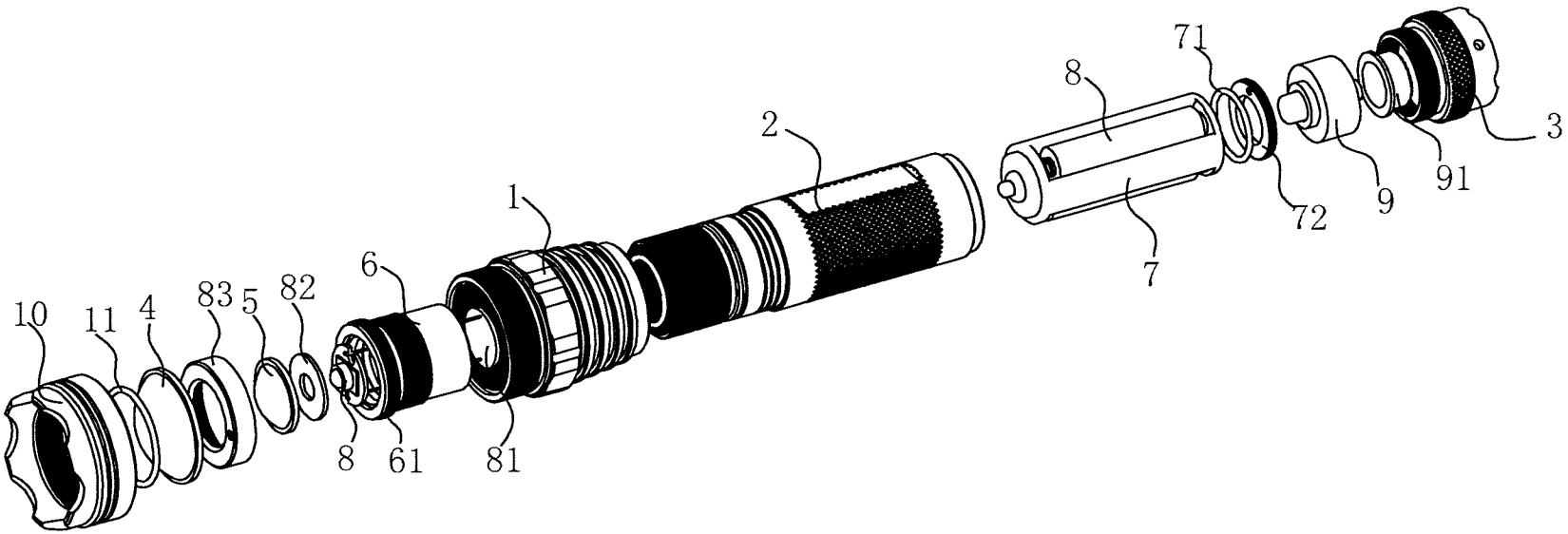
FIG. 3 is an exploded structure view of the present invention.
Figure 4:
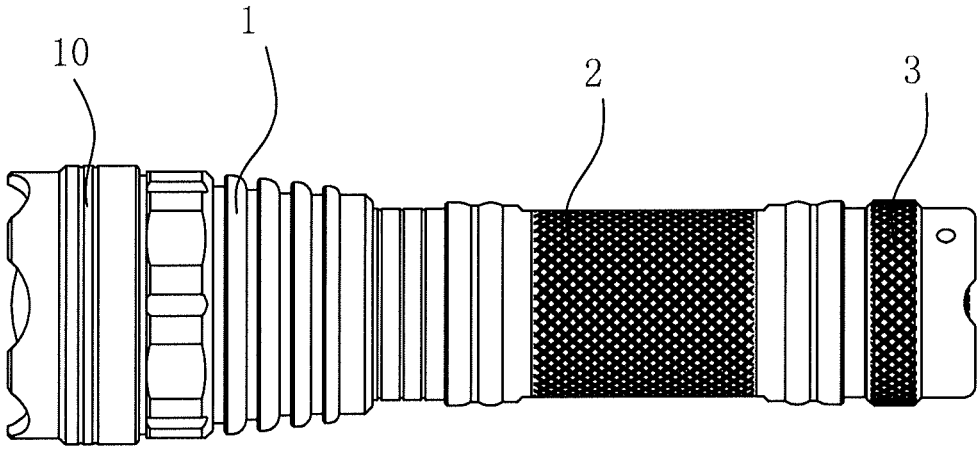
FIG. 4 is a three-dimensional structure view of the present invention when the cylinder body is stretched.
Figure 5:
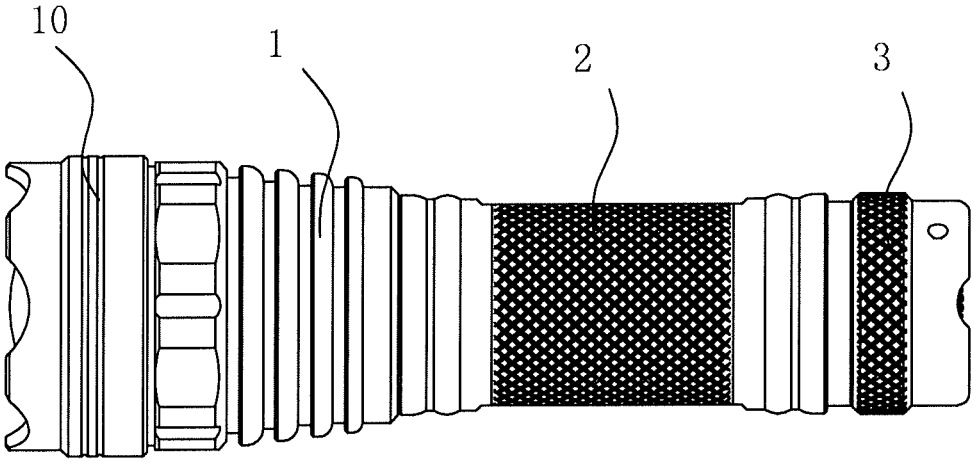
FIG. 5 is a three-dimensional structure view of the present invention when the cylinder body is contracted.

Further description is made below in details to the present invention with reference to the drawings and the embodiments.

A dual-lens zooming flashlight comprises a lamp cap 1, a cylinder body 2, a tail cover 3, an LED lamp 8, a first plano-convex lense 5, a second plano-convex lense 4, a control switch 9, a battery compartment 7 and other components, the lamp cap 1 is sleeved at the front part of the cylinder body 2, rotated together with the cylinder body 2 and connected with the cylinder body 2 in a relatively telescopic manner, the first and second plano-convex lenses 5 and 4 are both arranged in such a manner of being perpendicular to an optic axis in front of the LED lamp 8, wherein the first plano-convex lens 4 is fixedly arranged at the front end of the cylinder body and keeps a constant distance from the LED lamp 8, and the second plano-convex lens 4 is arranged at the front end of the lamp cap 1 and capable of moving backwards and forwards in relation to the LED lamp 8 along with rotary telescopic motion of the lamp cap 1 and the cylinder body 2; the front part of the lamp cap 1 is in threaded connection with a head ring 10, the second plano-convex lens 4 is arranged between the head ring 10 and the lamp cap 1 and is compressed and fixed by means of threaded connection between the head ring 10 and the lamp cap 1, and a waterproof O-shaped seal ring 11 is lined between the second plano-convex lens 4 and the head ring 10; the inner cavity of the cylinder body 2 is divided into two sections, i.e. a front section and a rear section, wherein a lamp holder 6 for fixing the LED lamp 8 is arranged on the front section, the battery compartment 7 is arranged on the rear section, the LED lamp 8 installed on an LED circuit board 81 and sleeved inside the lamp holder 6, the first plano-convex lens 5 is arranged in front of the LED lamp 8, and the first plano-convex lens 5 and the lamp holder 6 are compressed and fixed by a lens locking ring 83; a convex ring 61 which is abutted against the front end of the cylinder body 2 is formed at the front part of the lamp holder 6, the outer surface of the convex ring 61 and the outer surface of the front part of the lamp holder 6 are provided with external threads, an internal thread corresponding to the external thread on the front part of the lamp holder 6 is arranged on the inner wall of the front end of the cylinder body 2, and the lamp holder 6 is arranged inside the cylinder body 2 by means of threaded connection and is limited by end face fit of the convex ring 61 and the cylinder body 2; an internal thread which fits the external thread of the convex ring 61 is arranged at the inner side of the lens locking ring 83, a step which can be used for placement of the first plano-convex lens 5 is arranged at the inner side of the convex ring 61, and the lens locking ring 83 is sleeved on the convex ring 61 and is fixed with the lamp holder 6 in a manner of threaded connection, in this way, the first plano-convex lens 5 is fixed in front of the LED lamp 8; the front part of the cylinder body 2 is a reducing part that fits the rear end of the lamp cap 1, an external thread is formed at the outer side of the reducing part, a corresponding internal thread is arranged at the inner side of the rear end of the lamp cap 1, an expanding section for telescopic motion of the cylinder body 2 is formed at the inner end of the internal thread structure of the lamp cap, and the front part of the cylinder body 2 is telescopically sleeved inside the lamp cap 1 through the threaded structure and limited by fit between the lens locking ring 83 and the step surface of the expanding section; as a result, zooming can be completed quite conveniently as required only if there is a distance variation between the first plano-convex lens 5 and the second plano-convex lens 4 by rotation of the lamp cap 1 or the cylinder body 2; in addition, a pressure ring 82 is arranged between the LED lamp 8 and the first plano-convex lens 5, the battery compartment 7 is cylindrical and is internally divided into a receiving cavity for placement of three batteries 8, a waterproof ring 71 and a locking ring 72 are arranged at the tail of the battery compartment 7, and the front end of the battery compartment 7 is provided with a contact, which is electrically connected with the LED circuit board 8; the tail cover 3 is arranged at the rear end of the cylinder body 2 and fixed with the cylinder body 2 in a manner of threaded connection, a control switch 9 is arranged inside the tail cover 3, and a round hole, which is used for a button 91 of the control switch 9 to stretch out is arranged at the rear end of the tail cover 3.

Figure 6A:
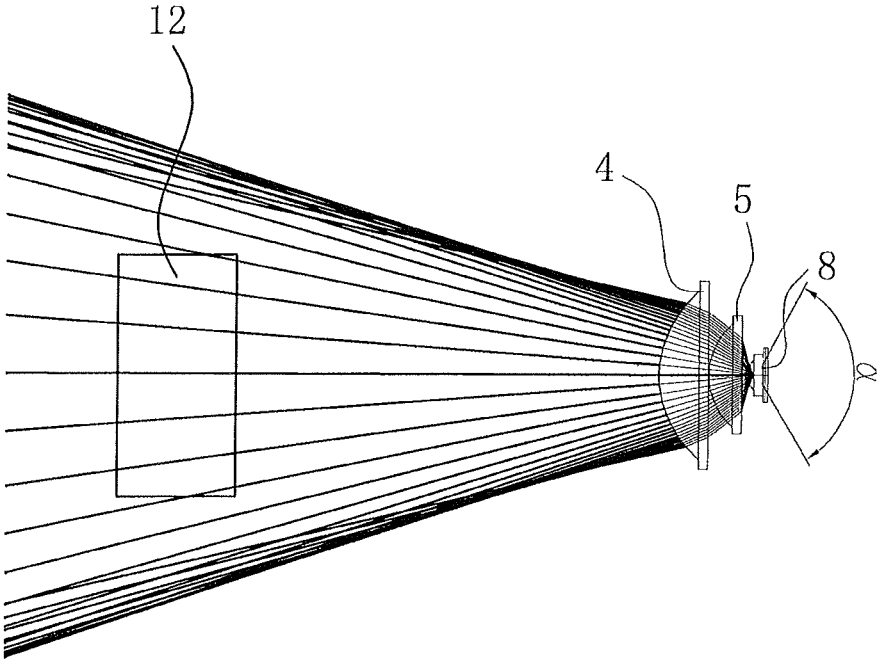
FIGS. 6A and 6B are directed to a zooming light path view of the present invention in the zooming process.
Figure 6B:
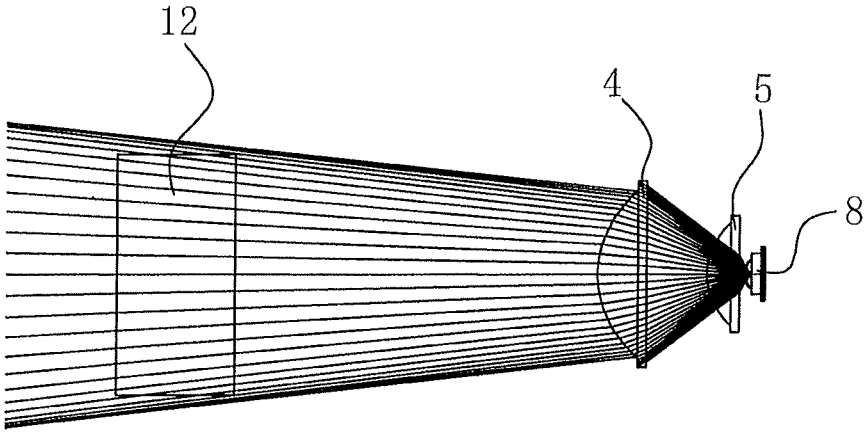

The light path view in the zooming process is as shown in FIG. 6, the combined lens structure results in a smaller light beam angle $\alpha$ emitted by the LED lamp 8, so that luminous flux on a reference object through the same area will increase correspondingly, and in FIG. 6(*b*), increase of the distance between the first plano-convex lens 5 and the second plano-convex lens 4 results in a smaller light beam angle $\alpha$ emitted by the LED lamp 8, so that luminous flux on a reference object through the same area becomes larger.

What claimed is:

1. A dual-lens zooming flashlight, comprising;

a lamp cap, a cylinder body, a luminous element, and two plano-convex lenses, wherein the lamp cap is sleeved at the front part of the cylinder body, rotated together with the cylinder body and connected with the cylinder body in a relatively telescopic manner, the two plano-convex lenses are both arranged in such a manner of being perpendicular to an optic axis in front of the luminous element, wherein the first plano-convex lens is fixedly arranged at the front end of the cylinder body and keeps a constant distance from the luminous element, and the second plano-convex lens is arranged at the front end of the lamp cap and capable of moving backwards and forwards in relation to the luminous element along with rotary telescopic motion of the lamp cap and the cylinder body, wherein the inner cavity of the cylinder body is divided into a front section and a rear section, wherein a lamp holder for fixing the luminous element is arranged on the front section, a battery compartment is arranged on the rear section, the luminous element is arranged on the lamp holder, the first plano-convex lens is arranged in front of the luminous element, and the first plano-convex lens and the lamp holder are compressed and fixed by a lens locking ring, and wherein a convex ring which is abutted against the front end of the cylinder body is formed at the front part of the lamp holder, the outer surface of the convex ring and the outer surface of the front part of the lamp holder are provided with external threads, an internal thread corresponding to the external thread on the front part of the lamp holder is arranged on the inner wall of the front end of the cylinder body, and the lamp holder is arranged inside the cylinder body by means of threaded connection and is limited by end face fit of the convex ring and the cylinder body.

2. The dual-lens zooming flashlight according to claim 1, wherein an internal thread which fits the external thread of the convex ring is arranged at the inner side of the lens locking ring, a step which can be used for placement of the first plano-convex lens is arranged at the inner side of the convex ring, and the lens locking ring is sleeved on the convex ring and is fixed with the lamp holder in a manner of threaded connection.

3. The dual-lens zooming flashlight according to claim 2, wherein the front part of the lamp cap is in threaded connection with a head ring, and the second plano-convex lens is arranged between the head ring and the lamp cap, and is compressed and fixed by means of threaded connection between the head ring and the lamp cap.

4. The dual-lens zooming flashlight according to claim 2, wherein the rear end of the cylinder body is connected with a tail cover, a control switch is arranged inside the tail cover, and a round hole, which is used for a button of the control switch to stretch out is arranged at the rear end of the tail cover.

5. The dual-lens zooming flashlight according to claim 1, wherein an external thread is formed at the outer side of the front part of the cylinder body, a corresponding internal thread is arranged at the inner side of the rear end of the lamp cap, an expanding section for telescopic motion of the cylinder body is formed at the inner end of the internal thread structure of the lamp cap, and the front part of the cylinder body is telescopically sleeved at the rear part of the lamp cap through the threaded structure and limited by fit between the lens locking ring and a step surface of the expanding section.

6. The dual-lens zooming flashlight according to claim 5, wherein the front part of the lamp cap is in threaded connection with a head ring, and the second plano-convex lens is arranged between the head ring and the lamp cap, and is compressed and fixed by means of threaded connection between the head ring and the lamp cap.

7. The dual-lens zooming flashlight according to claim 5, wherein the rear end of the cylinder body is connected with a tail cover, a control switch is arranged inside the tail cover, and a round hole, which is used for a button of the control switch to stretch out is arranged at the rear end of the tail cover.

8. A dual-lens zooming flashlight comprising:

a lamp cap, a cylinder body, a luminous element, and two plano-convex lenses, wherein the lamp cap is sleeved at the front part of the cylinder body, rotated together with the cylinder body and connected with the cylinder body in a relatively telescopic manner, the two plano-convex lenses are both arranged in such a manner of being perpendicular to an optic axis in front of the luminous element, wherein the first plano-convex lens is fixedly arranged at the front end of the cylinder body and keeps a constant distance from the luminous element, and the second plano-convex lens is arranged at the front end of the lamp cap and capable of moving backwards and forwards in relation to the luminous element along with rotary telescopic motion of the lamp cap and the cylinder body, wherein the inner cavity of the cylinder body is divided into a front section and a rear section, wherein a lamp holder for fixing the luminous element is arranged on the front section, a battery compartment is arranged on the rear section, the luminous element is arranged on the lamp holder, the first plano-convex lens is arranged in front of the luminous element, and the first plano-convex lens and the lamp holder are compressed and fixed by a lens locking ring, and wherein the luminous element is an LED lamp installed on an LED circuit board and sleeved in the lamp holder, a pressure ring is arranged between the LED lamp and the first plano-convex lens, a battery pack is arranged inside the battery compartment, and the front end of the battery compartment is provided with a contact, which is electrically connected with the LED circuit board.

9. The dual-lens zooming flashlight according to claim 8, wherein the battery compartment is cylindrical and is internally divided into a receiving cavity for placement of three batteries, and a waterproof ring and a locking ring are arranged at the tail of the battery compartment.

10. The dual-lens zooming flashlight according to claim 9, wherein the front part of the lamp cap is in threaded connection with a head ring, and the second plano-convex lens is arranged between the head ring and the lamp cap, and is compressed and fixed by means of threaded connection between the head ring and the lamp cap.

11. The dual-lens zooming flashlight according to claim 10, wherein a waterproof O-shaped seal ring is lined between the second plano-convex lens and the head ring.

12. The dual-lens zooming flashlight according to claim 9, wherein the rear end of the cylinder body is connected with a tail cover, a control switch is arranged inside the tail cover, and a round hole, which is used for a button of the control switch to stretch out is arranged at the rear end of the tail cover.

* * * * *